United States Patent [19]

Asano

[11] Patent Number: 4,691,630

[45] Date of Patent: Sep. 8, 1987

[54] INK-APPLYING MECHANISM OF A PRINTING MACHINE HAVING A RECIPROCATIVE PRINTING ROLL

[75] Inventor: Shinzo Asano, Yokohama, Japan

[73] Assignees: Asano Tekkosho Co., Ltd.; Fsk Co., Ltd., both of Tokyo, Japan

[21] Appl. No.: 839,903

[22] Filed: Mar. 14, 1986

[51] Int. Cl.[4] ..... B41F 31/00

[52] U.S. Cl. ..... 101/212; 101/348; 101/DIG. 6

[58] Field of Search ..... 101/212, 250, 252, 256, 101/257, 260, 269, 353, 356, 357, 358, 349, 350, 207–210, 354, 355, 56, 328, 329, DIG. 6

[56] References Cited

U.S. PATENT DOCUMENTS

| | | | |
|---|---|---|---|
| 2,711,693 | 6/1955 | Daniels | 101/353 |
| 2,841,081 | 7/1958 | Kaufmann | 101/353 |
| 4,057,013 | 11/1977 | Asano | 101/353 |

FOREIGN PATENT DOCUMENTS

| | | | |
|---|---|---|---|
| 69886 | 4/1941 | Denmark | 101/353 |

*Primary Examiner*—J. Reed Fisher

[57] ABSTRACT

An ink-applying mechanism comprises an ink pad which supplies ink from an ink source to a single series of sequentially contacting kneading rolls, the last roll in the series comprising a distributing roll which applied ink to first and second ink rolls through intervening rolls of a number ensuring rotation of the ink rolls in opposite directions. A pair of smoothing rolls are provided intermediate the printing rolls to ensure equal application of ink to each of the first and second rolls.

3 Claims, 2 Drawing Figures

INK-APPLYING MECHANISM OF A PRINTING MACHINE HAVING A RECIPROCATIVE PRINTING ROLL

An ink-applying mechanism of a printing machine is disclosed, in which an applying roll for applying an ink on the onward way to a printing face of the printing roll which is reciprocative and reversibly rotatable, and another applying roll for applying the ink on the return way to said printing face are contacted each with a respective ink roll rotating in the reverse direction relative to the applying roll, while these ink rolls are supplied with an ink from an ink-container continuously through a plurality of associated and sequentially contacted kneading roll.

In the mechanism an ink pad for feeding the ink from the ink container is contacted with an end roll of a series of the sequentially contacted and associated kneading rolls while the other end roll of said series of the kneading rolls is used as a distributing roll which is contacted directly or through not more than two rolls with the respective ink roll.

FIELD OF THE INVENTION

This invention relates to an improved ink-applying mechanism in a printing machine which has been proposed in Japanese Patent Application No. 50-60441 (Japanese Patent Publication No. 53-6565).

BACKGROUND OF THE INVENTION

The printing machine proposed in Japanese Pat. Publication No. 53-6565 has a structure as shown in FIG. 1, in which an applying roll 23 for applying an ink on the onward way to printing face 22 of the printing roll 21 which is reciprocative and reversibly rotatable, and another applying roll 24 for applying the ink on the return way to said printing face 22 are contacted each with a respective ink roll 25, 26 rotating in the reverse direction relative to each applying roll 23, 24. An ink from an ink-container 27 is transferred to an ink-pad 28 for feeding the ink to a distributing roll 29 and then is supplied through a plurality of kneading rolls 30 via separate routes to each of the respective ink rolls 25, 26 continuously.

Consequently, the ink transferred from the ink pad 28 to the distributing roll 29 is transferred at first to one end roll 31 (right side in FIG. 1) in one series of the kneading rolls 30 and then the ink remaining on the distributing roll 29 is transferred to one end roll 32 (left side in FIG. 1) of the other series of the kneading rolls 30 when the distributing roll 29 is rotating in the clockwise direction. As a result a transferred amount of the ink on the end roll 31 in the one series becomes different from that on the end roll 32 in the other series, resulting in unevenness of the ink onto each of the applying rolls 23 and 24.

Further, the number of the kneading rolls 30 is large due to the presence of the two different series, bringing about a complicated and large sized mechanism.

OBJECT OF THE INVENTION

In view of the foregoing, an object of the invention is to solve the above-said problems and to achieve uniform application of the ink onto each applying roll for transferring the ink to the printing face of the printing roll, as well as reduction of the number and size of the kneading rolls in the printing machine having the reciprocative printing roll.

SUMMARY OF THE INVENTION

In order to achieve the above object, the invention relates to an ink-applying mechanism for a printing machine having a reciprocative printing roll, in which an applying roll for applying an ink on the onward way to a printing face of the printing roll which is reciprocative and reversibly rotatable, and another applying roll for applying the ink on the return way to said printing face are contacted each with a respective ink roll rotating in the reverse direction relative to the applying roll, while these ink rolls are supplied with an ink from an ink-container continuously through a plurality of associated and sequentially contacted kneading rolls, characterized in that an ink pad for feeding the ink from the ink container is contacted with an end roll of a series of the sequentially contacted and associated kneading rolls while the other end roll of said series of the kneading rolls is used as a distributing roll which is contacted directly or through not more than two rolls with the respective ink roll, so that one ink roll and the other ink roll may be rotated reversely relative to each other, and these ink rolls are directly contacted through two rolls.

The invention will be described for its preferred embodiments with reference to the accompanying drawings.

PREFERRED EMBODIMENTS OF THE INVENTION

Figure 1:
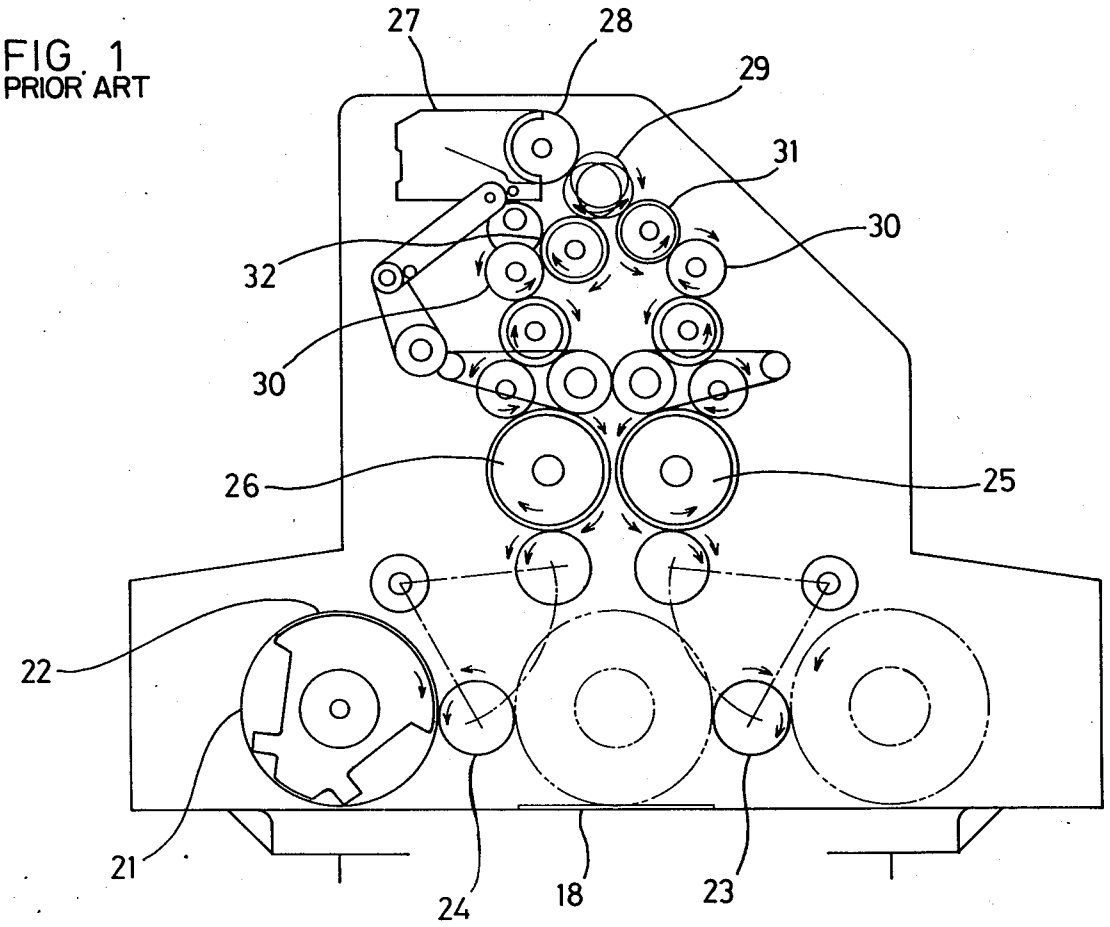
FIG. 1 PRIOR ART
FIG. 1 is a schematic plan view of one embodiment of conventional printing machines having a reciprocative printing roll.
Figure 2:
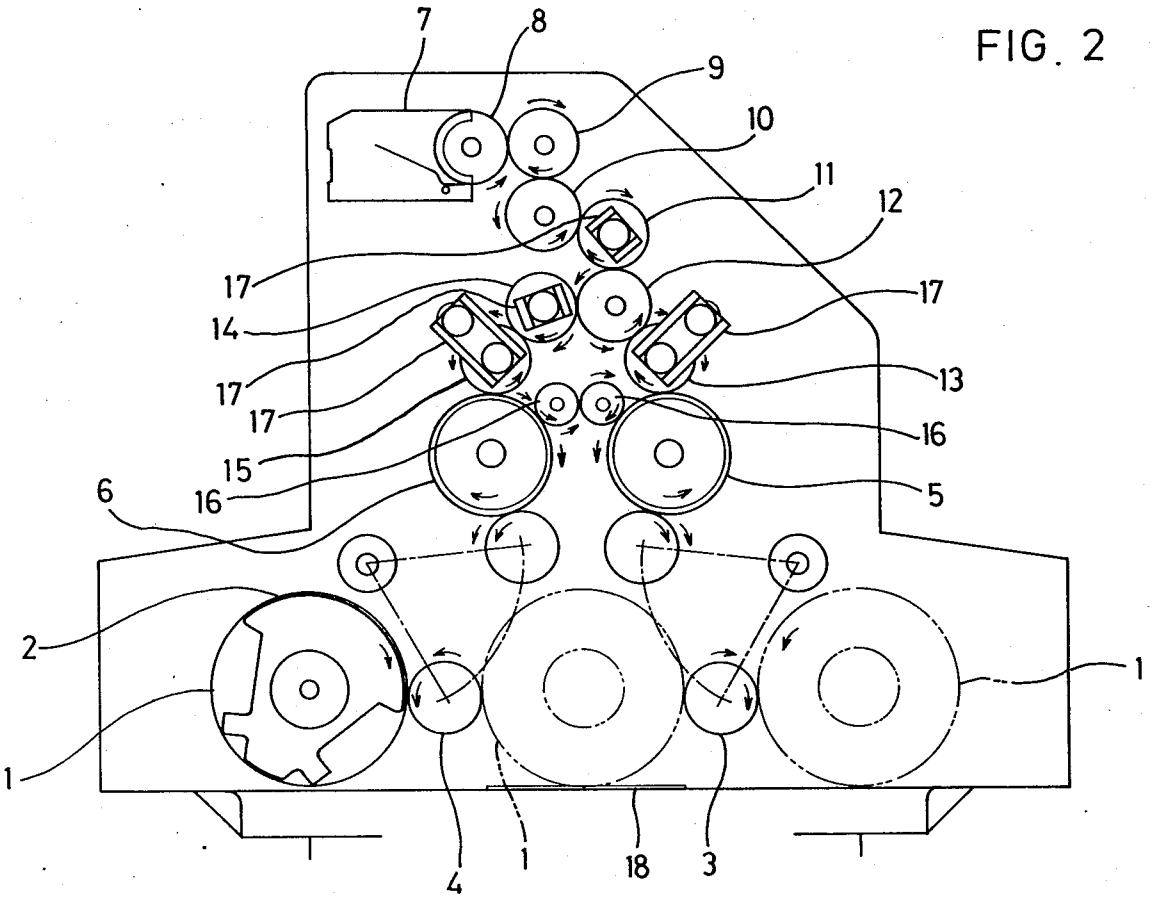
FIG. 2 is a schematic front view showing a main portion of a printing machine having a reciprocative printing roll which incorporates one embodiment of an ink-applying mechanism according to the invention.

In FIG. 2, reference 1 represents a printing roll which is reciprocative and reversibly rotatable.

The printing roll 1 is contacted with ink-applying rolls 3 and 4 for applying an ink, one of which is contacted with a printing face 2 of the printing roll 1 and rotates clockwise when the printing roll 1 rotates counter-clockwise in the onward way, while the other one is contacted with the printing face 2 and rotates counter-clockwise when the printing roll 1 rotates clockwise in the return way. Each of these applying rolls 3, 4 is swingable upwardly for contacting with a respective ink-roll 5 or 6 thereby to transfer the ink.

Each ink-roll 5, 6 may be supplied with the ink from an ink container 7 by means of an ink pad 8 which is contacted with a kneading roll 9 while the latter in turn is contacted with another kneading roll 10. The kneading roll 10 is associated with a distributing roll 12 through a contact-adjusting roll 11. The distributing roll 12 is contacted with one of the ink rolls 5 through a contact-adjusting roll 13 on the one hand and contacted with the other ink roll 6 through a direction-converting roll 14 and another contact-adjusting roll 15 on the other hand. In addition to the kneading rolls 9 and 10, the contact-adjusting roll 11 and the distributing roll 12 also serve as kneading rolls. Thus, the kneading rolls 9 and 10, the contact-adjusting roll 11 and the distributing roll 12 form a series of kneading rolls, one end roll 9 of which is contacted with the ink pad 8 while the other end roll is served as the distributing roll 12. The series of kneading rolls are contacted sequentially and associated with each other. In this case, the kneading roll 9 may be arranged in such a way that it can be spaced apart from the ink pad 8 and the kneading roll 10 at any time for discontinuing the ink supply from the ink container 7, which construction is, however, not shown in the drawings. The ink rolls 5 and 6 are contacted with each other through not only the kneading rolls 9, 10 and the contact-adjusting roll 13 but also through two ink-levelling rolls 16. Thus, even when the ink rolls 5 and 6 are rotated in the opposite direction to each other by combination of the rolls 9,10,11,12,13,14 and 15, the ink rolls 5 and 6 may be contacted through the ink-levelling rolls 16 without any trouble. Further, even if the ink has not been applied uniformly onto the ink rolls 5 and 6, the ink-levelling rolls 16 may smooth the applied ink.

In the drawings, reference 17 represents an adjusting guide for adjusting position of the contact-adjusting rolls 11, 13, 15 and the direction-converting roll 14, while reference 18 stands for a sheet of printing paper to be fed in a direction normal to reciprocal movement of the printing roll 1. A thick arrow shows an ink flow, while a thin arrow shows a rotating direction of each roll. Further, the distributing roll 12 and the ink roll 5 may be directly contacted with each other without arranging the contact-adjusting rolls 13 and 15 therebetween, except the direction-converting roll 14 may be arranged between the distributing roll 12 and the ink roll 6.

With the printing machine having the printing roll 1 reciprocative and reversibly rotatable according to the invention, the ink-transferring construction from the ink container 7 to the ink rolls 5, 6 for applying the ink onto the ink-applying rolls 3, 4 (which in turn applies the ink onto the printing face of the printing roll 1) may be very simple, and unevenness of the ink on the ink rolls 5, 6 may be avoided, resulting in excellent printings.

Thus, in accordance with the invention, there may be provided the ink-applying mechanism for the printing machine having the reciprocative printing roll 1, in which the applying roll 3 for applying the ink on the onward way to the printing face 2 of the printing roll 1 which is reciprocative and reversibly rotatable, and the other applying roll 4 for applying the ink on the return way to said printing face 2 are contacted each with the respective ink roll 5, 6 rotating in the reverse direction relative to the applying roll 3, while these ink rolls 5, 6 are supplied with the ink from the ink-container 7 continuously through a plurality of associated and sequentially contacted kneading rolls 9. In the printing mechanism thus constructed according to the invention, the ink pad 8 for feeding the ink from the ink container 7 is contacted with the end roll 9 of a series of the sequentially contacted and associated kneading rolls, the other end roll in said series of kneading rolls, comprising the distributing roll 12, is contacted directly or through not more than two rolls with the respective ink roll 5, 6, so that one ink roll 5 and the other ink roll 6 may be rotated reversely relative to each other, and these ink rolls are directly contacted through two rolls. Thus, in comparison with the conventional printing machine having a plurality of separate series of the kneading rolls 30 for continuously supplying the ink to the respective ink roll 25, 26, the printing mechanism according to the invention may supply the ink continuously from the ink container 7 to the ink rolls 5, 6 only through a single series of the kneading rolls and through division of the series into two series finally by the distributing roll 12 or only through not more than two rolls, so that the number of the rolls may be very much reduced, resulting in a simple and compact construction.

Due to the distributing roll 12 applying ink to the two rolls 5, 6 as described one roll may initially take up the ink and then the other roll during transfer from the distributing roll 12. Thus, the first roll may take up more ink than the other roll. However, by virtue of the ink rolls 5 and 6 being directly connected by rolls 16, 16 the ink will be smoothed, or leveled and equally applied to ink rolls 5 and 6.

Still further, each roll 1, 3–6, 9–16 may be rotated conversely to the ink-feeding direction in order to pour a cleaning liquid, such as an organic solvent, onto the roll surfaces, thereby to facilitate the cleaning of the rolls by scraping the ink from a single site because the plural rolls 1, 3–6, 9–16 form an associated system.

It will be appreciated from the above description that the mechanism according to the invention may simplify the construction of the printing machine and avoid unevenness of the ink on the ink rolls, so that the printing machine having the reciprocative printing roll may be manufactured in a compact size. Further, each roll may be cleaned conveniently for providing the uniform and excellent printings. Of course, the printing machine of the invention may be provided at a low cost due to its simple and compact construction.

What is claimed is:

1. An ink-applying mechanism for a printing mechanism having a rotative printing roll reciprocative along an onward and a return way in which a first applying roll applies ink during the onward way of the printing roll to a printing face thereof, and a second applying roll applying ink to said printing face during the return way of the printing roll, said first and second applying rolls for this purpose being in contact with respective first and second ink rolls rotating in direction reverse to that of the first and second applying roll, said first and second ink rolls being supplied with ink from an ink-container through a single series of associated, sequentially contacting, kneading rolls, a first kneading roll in said series engaging an ink pad for feeding the ink from the ink container to said series of sequentially contacting kneading rolls, a last of said series of kneading rolls, distant from said first kneading roll, comprising a distributing roll which effectively rotates the first and second ink rolls in opposite directions relative to one another, and ink smoothing means comprising two rolls intermediate said first and second ink rolls and contacting said first and second ink rolls for smoothing ink supplied by said distributing roll to said first and second ink rolls.

2. The mechanism of claim 1, wherein said distributing roll drives said first ink roll by way of a contact adjusting roll arranged intermediate said distributing roll and said first ink roll and driving said second ink roll by way of contact adjusting roll in combination with a direction converting roll.

3. The mechanism of claim 1, wherein said ink smoothing means comprising said two intermediate rolls, are located between said first and second ink rolls in the nip thereof.

* * * * *